US011253867B2

(12) United States Patent
Hsiao et al.

(10) Patent No.: US 11,253,867 B2
(45) Date of Patent: Feb. 22, 2022

(54) DRY NANO-SIZING EQUIPMENT WITH FLUID MOBILITY EFFECT

(71) Applicants: Chih-Yuan Hsiao, Taoyuan (TW); Yu-Chih Hsiao, Taoyuan (TW)

(72) Inventors: Chih-Yuan Hsiao, Taoyuan (TW); Yu-Chih Hsiao, Taoyuan (TW)

( * ) Notice: Subject to any disclaimer, the term of this patent is extended or adjusted under 35 U.S.C. 154(b) by 210 days.

(21) Appl. No.: 16/655,564

(22) Filed: Oct. 17, 2019

(65) Prior Publication Data

US 2021/0053070 A1 Feb. 25, 2021

(30) Foreign Application Priority Data

Aug. 20, 2019 (TW) ..... 108211131

(51) Int. Cl.
*B02C 19/00* (2006.01)
*B02C 13/286* (2006.01)
*B02C 13/288* (2006.01)

(52) U.S. Cl.
CPC ..... *B02C 19/0025* (2013.01); *B02C 13/286* (2013.01); *B02C 13/288* (2013.01); *B02C 19/0043* (2013.01); *B02C 2013/28609* (2013.01)

(58) Field of Classification Search
CPC ..... B02C 19/0025; B02C 19/0043; B02C 19/0037; B02C 13/288; B02C 13/286; B02C 13/10; B02C 13/08
See application file for complete search history.

(56) References Cited

U.S. PATENT DOCUMENTS 2,609,995 A * 9/1952 Klagsbrunn ..... B02C 13/12 241/154
4,101,080 A * 7/1978 Schmidt ..... B02C 13/08 241/194
4,428,536 A * 1/1984 Rodgers ..... B02C 13/13 241/52
4,733,826 A * 3/1988 Komori ..... B02C 23/12 241/188.1
6,021,966 A * 2/2000 Doenges ..... B02C 13/08 241/189.1
6,431,477 B1 * 8/2002 Pallmann ..... B02C 13/08 241/186.3
7,708,216 B2 * 5/2010 Yang ..... B02C 13/282 241/55
9,327,290 B2 * 5/2016 Alekseev ..... B02C 23/18
10,722,897 B2 * 7/2020 Pallmann ..... B02C 23/24

FOREIGN PATENT DOCUMENTS

TW I428186 B 3/2014

* cited by examiner

*Primary Examiner* — Faye Francis
(74) *Attorney, Agent, or Firm* — Muncy, Geissler, Olds & Lowe, P.C.

(57) ABSTRACT

Dry nano-sizing equipment with fluid mobility effect dryly processes viewable fine-grained substances into a nano-sized dimension by high-pressure airflow resulted from a pressure-generating unit, as well as high-speed fluid and high mechanical momentum generated in a pressure cylinder by high-speed rotation of a booster impeller.

10 Claims, 10 Drawing Sheets

DRY NANO-SIZING EQUIPMENT WITH FLUID MOBILITY EFFECT

BACKGROUND OF THE INVENTION a) Field of the Invention

The present invention relates to dry nano-sizing equipment with fluid mobility effect and more particularly to a device system required for the equipment that dryly processes viewable fine-grained substances into a nano-sized dimension by pressure difference of airflow and high momentum resulted from mechanical work.

b) Description of the Prior Art

Nano-sizing provides a brand new application to industrial materials and requirements of life in innovative areas. The related methods of nano-sizing include electrolyzing, magnetic cutting, ultrasonic dispersion, jetting or chemical dispersion & dissolution. If the material quality complies with a fundamental method, then a grinding method can be used to achieve disintegration into a nano-dimension. The grinding method is disclosed in a Taiwanese Patent No. 100106419 (as shown in FIG. 1), wherein a grinding machine is used to grind substances into the nano-dimension. The grinding machine includes a single body of grinding barrel 101 that contains a barrel-like guiding workpiece 102 and a spiral turbine 103. A bottom of the grinding barrel 101 is sealed with a bottom plate 104, and a lower end of the spiral turbine 103 is provided with a combining portion 105 that provides for connection to a motor 106 at the bottom. In addition, an upper side of the grinding barrel 101 is provided with an opening to provide for access of the substances.

As the substances are grinded repeatedly and continuously in the grinding barrel 101, there is a very high probability that the nano-sized substances are grinded repeatedly; therefore, the grinding efficiency is not high. On the other hand, as the poured abrasives are not screened, the grain sizes will not be uniform, which results in a poor effectiveness.

SUMMARY OF THE INVENTION

A primary object of the present invention is to provide dry nano-sizing equipment with fluid mobility effect, wherein the equipment dryly processes viewable fine-grained substances into the nano-dimension. The equipment carries out a disintegration operation, including compression, pulling, percussion, cutting & rubbing, to nano-size the fine-grained substances by high-pressure airflow from a pressure-generating unit and a booster impeller that rotates in high speed to form high momentum inside a pressure cylinder.

A second object of the present invention is to provide dry nano-sizing equipment with fluid mobility effect, wherein the pressure-generating unit is provided with a covering drum. An interior of the covering drum is provided with a draining shaft to drive the booster impeller, and the draining shaft is axially provided with a semi-opened pressure cabin. When the equipment is operating, an entrance that is connected to the pressure cabin entrains the processed materials by negative pressure, and the processed materials are distributed in a pressure cylinder of the covering drum through pressure rabbets and a bus rabbet, so that the equipment can operate the disintegration by the draining shaft and the booster impeller.

A third object of the present invention is to provide dry nano-sizing equipment with fluid mobility effect, wherein a lateral shape of vanes provided by the booster impeller can be straight or arch, with that the area of vanes are larger for the shape of arch to result in a different working efficiency.

A fourth object of the present invention is to provide dry nano-sizing equipment with fluid mobility effect, wherein a feeding unit is disposed inside the pressure cylinder to feed in fine-grained substances to be processed. In addition, on a same input side, an auxiliary device is used to mix in gas in low temperature for cooling or inert gas for prevention from explosion.

A fifth object of the present invention is to provide dry nano-sizing equipment with fluid mobility effect, wherein a longitudinal line of an exit port provided by the covering drum passes through a rotation axis against which the equipment operates or is parallel to a tangent of the rotation axis, in order to determine various outputs of air momentum.

A sixth object of the present invention is to provide dry nano-sizing equipment with fluid mobility effect, wherein an outer end of the exit port is provided with an accelerating tube, and a rigid counter pillow is disposed vertically along an exit direction of the accelerating tube, with reaction force resulted from the counter pillow aiding the disintegration operation.

A seventh object of the present invention is to provide dry nano-sizing equipment with fluid mobility effect, wherein a circumference of the pressure cylinder in the covering drum is provided divergently with a feedback tube to aid inner circulation. The feedback tube is provided with a follower port in a large aperture to face the operational direction of booster impeller, as well as a return port that follows the operational direction of booster impeller.

An eighth object of the present invention is to provide dry nano-sizing equipment with fluid mobility effect. The pressure-generating unit can be combined coaxially front and back, wherein a prepositional pressure-generating unit entrains the processed materials, and the operational airflow boosts up a postpositional pressure-generating unit that is provided outward with the exit port to discharge the processed materials.

A ninth object of the present invention is to provide dry nano-sizing equipment with fluid mobility effect, wherein the pressure-generating unit is further connected with a separation device which separates the nano-sized processed materials from the non-nano-sized processed materials by pressure. In addition, the separation device can be connected serially into plural sets, which increases the screening rate per unit time.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

The present invention discloses dry nano-sizing equipment with fluid mobility effect to dryly process viewable fine-grained substances into a nano-dimension, wherein the viewable fine-grained substances are disintegrated into the nano-dimension in high kinetic energy by the working principle of fluid and the operation of mechanical momentum.

The implementation and the working methods of the present invention are described hereinafter in reference to drawings.

Figure 1:
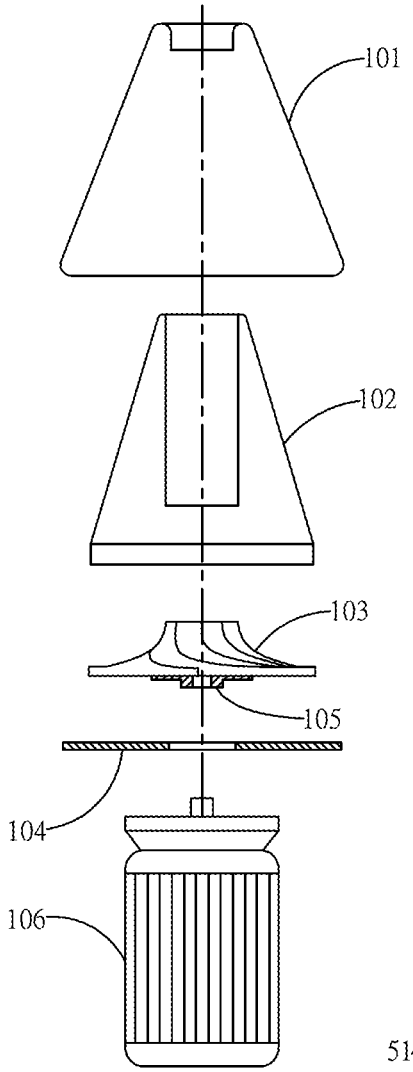
FIG.1 Prior Art
FIG. 1 shows a structural diagram of a conventional nano-grinding machine.
Figure 2:
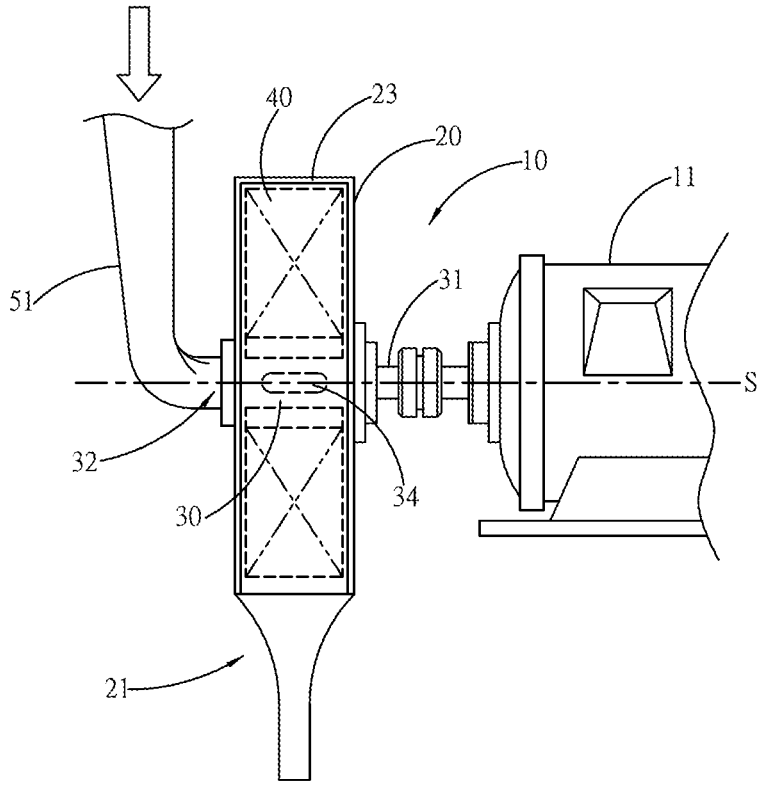
FIG. 2 shows a schematic view of a main device of pressure-generating unit, according to the present invention.

Referring to FIG. 2, the present invention comprises primarily a pressure-generating unit 10 that results in high-valued working energy to disintegrate effectively viewable processed materials (raw materials) in particulate size into a nano-dimension. The materials are dry, inorganic or organic particulate substances, and in the specification, are defined as the processed materials, fine-grained substances or raw materials. In addition, the fine-grained substances can be grains or inorganic minerals that are coarse crushed or fine crushed in advance.

The equipment is provided with a rotation axis S for operation, a primary shaft 31 is provided against the rotation axis S to be driven by a power unit 11. The power unit 11 is an electric or hydraulic power machinery. The primary shaft 31 drives a draining shaft 30 inside the pressure-generating unit 10, and the draining shaft 30 drives a booster impeller 40. The draining shaft 30 and the booster impeller 40 operate in a pressure cylinder 23 which is disposed inside a rigid covering drum 20, and a radial circumference of the pressure cylinder 23 is connected outward with an exit port 21.

An end of the draining shaft 30 is provided with an entrance 32, and the entrance 32 receives fine-grained substances to be processed (not shown on the drawing) that are fed in from a piping 51. The processed materials are delivered into a working envelope of the booster impeller 40 through pressure rabbets 34 of the draining shaft 30.

Figure 3:
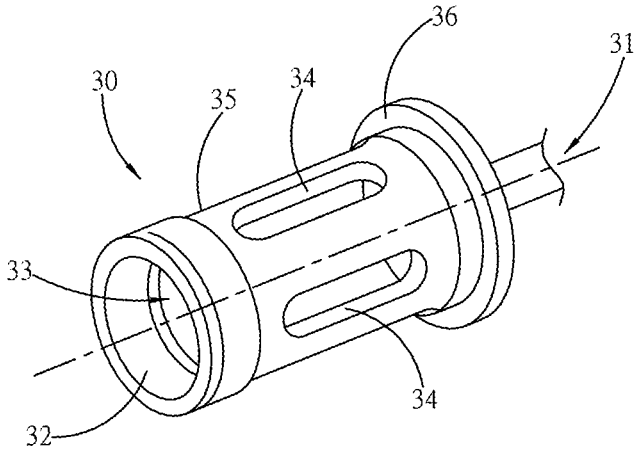
FIG. 3 shows a three-dimensional view of a draining shaft provided by the pressure-generating unit, according to the present invention.

Referring to FIG. 3, the draining shaft 30 is a barrel-like body, and an opening on one end thereof is the entrance 32; whereas, a pressure cabin 33, which is coaxial with the entrance 32, is concaved into the draining shaft 30. The pressure cabin 33 is radially opened with the equiangular pressure rabbets 34 that penetrate the outer circumference thereof. The other end of the draining shaft 30 is coaxially linked to the primary shaft 31, and the end is sealed with a disc-shaped radial plate 36, which makes the pressure cabin 33 a round tank. The outer circumference of the draining shaft 30 can cover the length of the pressure rabbets 34, and the draining shaft 30 is radially concaved with a waist 35.

Figure 4:
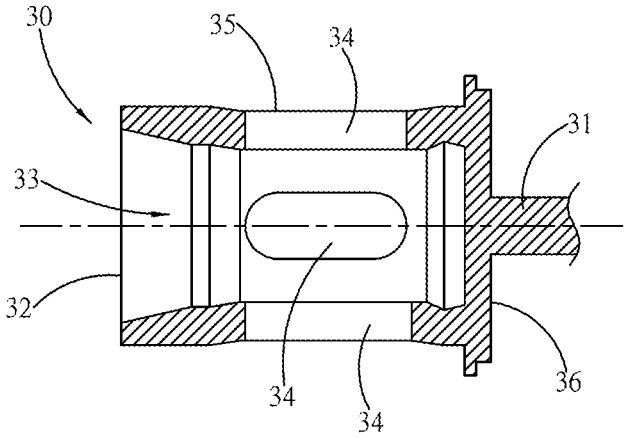
FIG. 4 shows a side cutaway view of FIG. 3.

Referring to FIG. 4, as described above, one end of the draining shaft 30 is the radial plate 36, a center of which is combined coaxially with the primary shaft 31; whereas, the other end is the entrance 32 that is coaxially concaved with the pressure cabin 33. The pressure cabin 33 is connected outward through the equiangular pressure rabbets 34 that are opened radially. An outer surface of the draining shaft 30 is concaved with the waist 35, and the width of the waist 35 can be larger than the length of the pressure rabbets 34.

Figure 5:
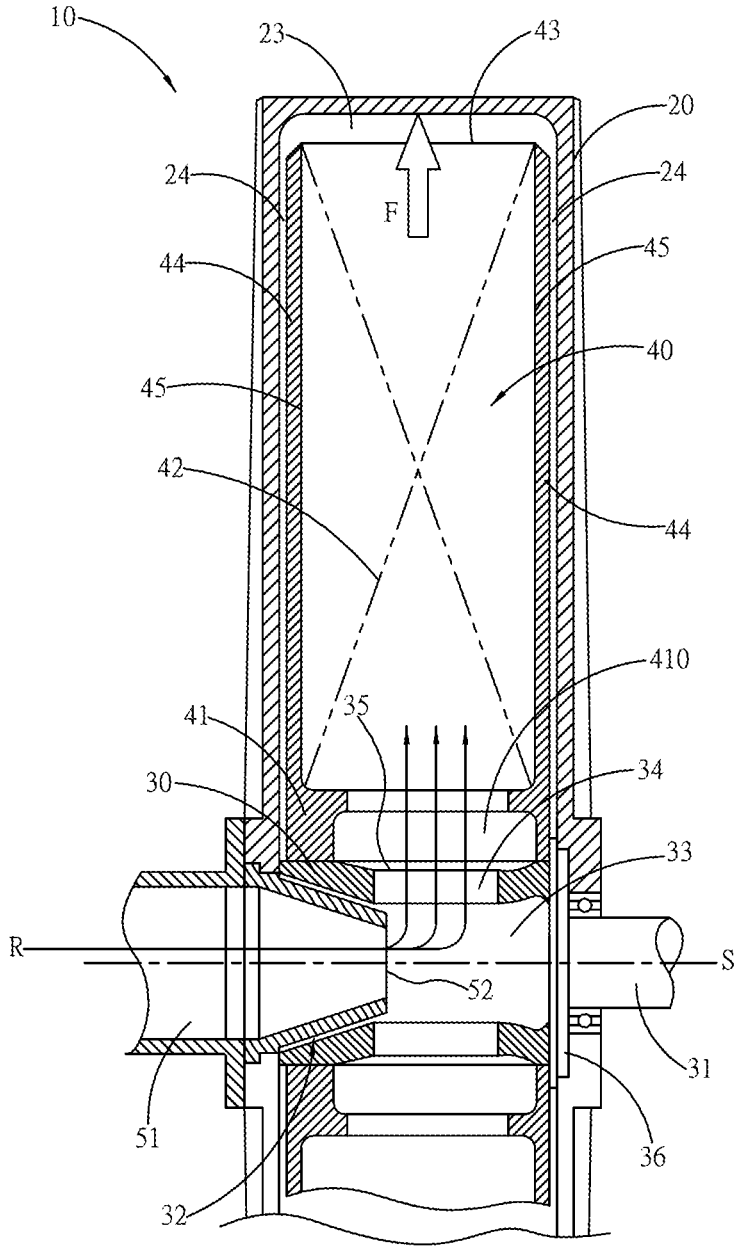
FIG. 5 shows a side view of internal mechanisms of the pressure-generating unit, according to the present invention.

Referring to FIG. 5 (along with FIG. 2), the pressure-generating unit 10 is basically provided with the rigid covering drum 20, and an interior of the covering drum 20 is coaxial with the rotation axis S, forming the round cabin-like pressure cylinder 23 by conjugate rotation. An interior of the pressure cylinder 23 is coaxially installed with the draining shaft 30, and the outer circumference of the draining shaft 30 is combined with the booster impeller 40. An end of the draining shaft 30 is linked to the primary shaft 31, the primary shaft 31 penetrates the outer side of the covering drum 20 to link the power unit 11, and the other end of the covering drum 20 provides for tight combination with the piping 51. A feeding port 52 provided by the piping 51 faces right in front of the entrance 32 to connect with the space in the pressure cabin 33, and the pressure cabin 33 is connected to the working envelope of the booster impeller 40 through the pressure rabbets 34.

Figure 11:
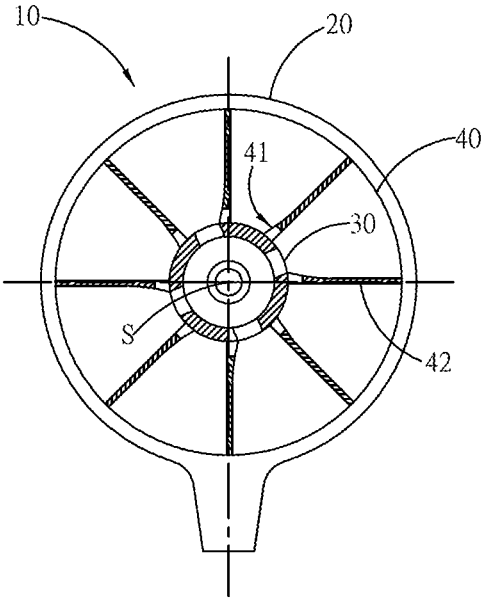
FIG. 11 shows a schematic view of a shape of booster impeller, according to the present invention.
Figure 12:
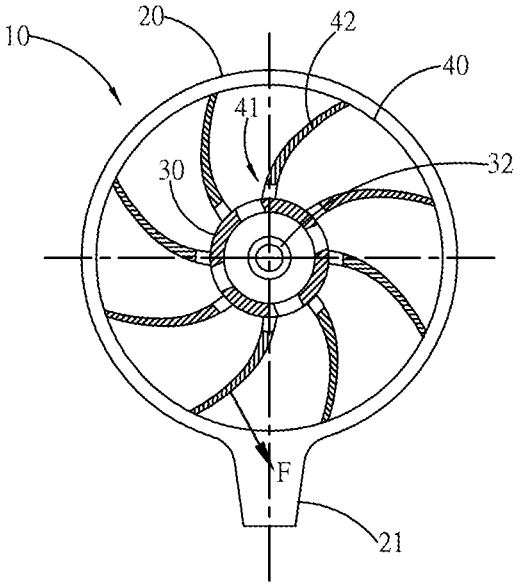
FIG. 12 shows part of FIG. 11.
Figure 13:
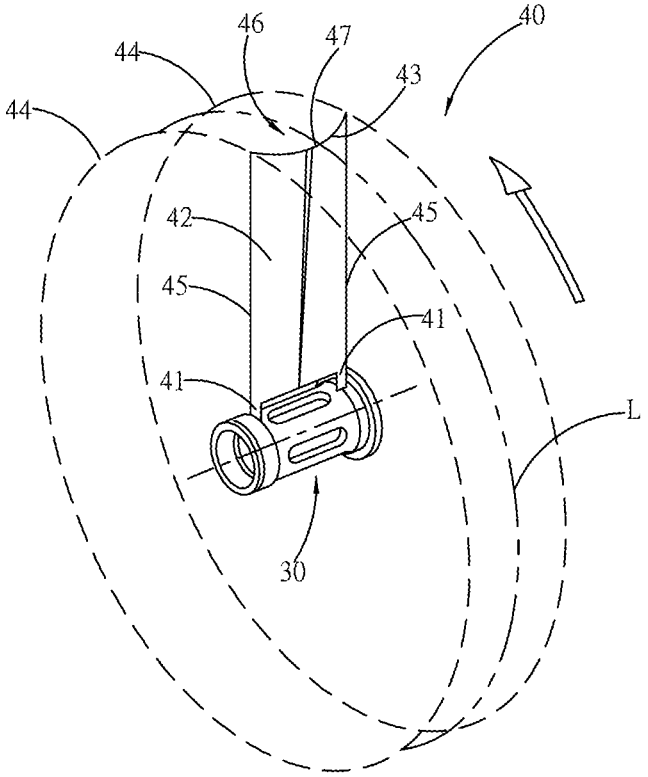
FIG. 13 shows a schematic view of a shape of vane surfaces on vanes provided by the booster impeller, according to the present invention.
Figure 14:
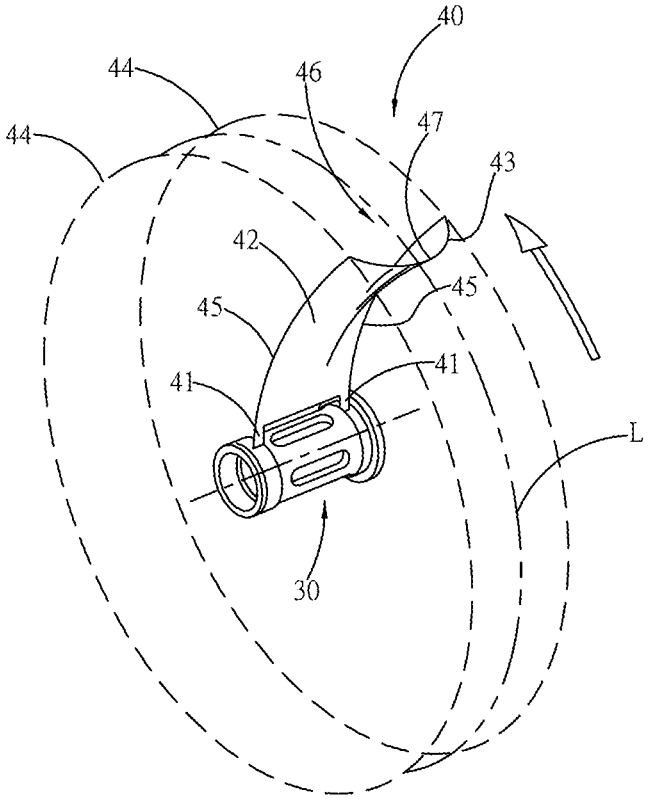
FIG. 14 shows part of FIG. 13.

The booster impeller 40 is provided with plural vanes 42 (as shown in FIG. 11 and FIG. 12), and each vane 42 is radially combined on the outer circumference of the draining shaft 30 in an equiangular pattern against the rotation axis S by a root portion 41. On a front and rear end of the main structure of booster impeller 40, a spoke 44 thereof is combined with a vane side 45 on each vane 42 to form a circular block (as shown in FIG. 13 and FIG. 14).

The number of pressure rabbets 34 is not the same as that of vanes 42. In order to uniform the spreading angles at which the processed materials enter into the pressure cylinder 23, and to equalize the pressure in the included angles between every two vanes 42, therefore, the pressure rabbets 34 have to penetrate the outer circumference annularly on the draining shaft 30 through a bus rabbet 410. The structure type is that the bus rabbet 410 is preserved between the root portion 41 and the outer circumference of draining shaft 30. The bus rabbet 410 can be concaved into a side on the root portion 41 in adjacent to the outer surface of draining shaft 30 or be formed by a concaved space of the waist 35 relative to the bottom edge of root portion 41. The bus rabbet 410 can primarily penetrate and surround the outer circumference of draining shaft 30 annularly to isopiestically distribute the airflow that is guided through the pressure rabbets 34 in the included angles between every two vanes 42. In the space of pressure cylinder 23, the entire combination of draining shaft 30 and booster impeller 40 rotates coaxially in the pressure cylinder 23 which is enclosed by the covering drum 20, forming a restricted space for the airflow except for the necessary airflow paths.

When the equipment operates, pressure is generated in the pressure cylinder 23, and the processed materials (not shown on the drawings) enter into the pressure cabin 33 by the function of that pressure (negative pressure), followed by being transmitted to a holding space of the booster impeller 40 through the pressure rabbets 34 and the bus rabbet 410. The processed materials are fed in following a swarming route R along which ambient air in atmospheric pressure is guided in, passively resulting in positive fluid pressure F after being spread and transferred into the pressure cylinder 23 through the vanes 42.

For the disintegration operation of equipment, shaft power inputted to the primary shaft 31 results in torque to twist the draining shaft 30 that links the booster impeller 40. During the process, the processed materials that are transferred along the swarming route R are first entrained by negative pressure resulted from the pressure cabin 33 due to the function of booster impeller 40. Next, the under the high-speed operation of draining shaft 30, the processed materials that flow through the pressure rabbets 34 will be smashed prepositionally by shearing & percussion on the surface of opening of the pressure rabbets 34. The processed materials flow through the edges of bus rabbet 410 and percussed by the edges, such as corners, of bus rabbet 410 again, forming secondary mechanical smashing. The booster impeller 40 and the draining shaft 30 operate synchronously, and the vanes 42 receive again the raw materials that are transmitted through the bus rabbet 410.

The pressure generated by the rotation of vanes 42 operates the processed materials on the vane surface, causing mechanical squeezing and pneumatic compression. The molecular structures of the processed materials are compressed and then collapsed again. The processed materials finally operate on the inner radial circumference of pressure cylinder 23, following the momentum caused by the speed and the mass of high-speed airflow. According to the law of motion, the momentum operates on the inner circumference of pressure cylinder 23, and then the pressure cylinder 23 results in force in equal size but opposite direction correspondingly. That force operates directly on the body of particulate substances. Therefore, the substances are fractured and disintegrated again. In the description above, the processed materials circulate and swarm in the pressure cylinder 23 one time, being disintegrated by the combined action of multiple physical energies including mechanical smashing, squeezing and collapsing. In addition, as the speed of airflow is high, the momentum of disintegration is augmented explicitly, which improves the disintegration efficiency of the processed materials.

The piping 51 is provided with the feeding port 52 to provide access of the processed materials. The feeding port 52 is disposed in adjacent to a central position of the pressure rabbets 34 in the pressure cabin 33, allowing the entrained materials to be transmitted along a longitudinal centerline of the vanes 42 in a fixed direction, so that the force exerted on the surface of vanes 42 can be balanced or uniform. Therefore, according to the taper shape of entrance 32, the piping 51 is converged into a shape of tip, allowing the feeding port 52 to be extended into an inner space of the pressure cabin 33.

A front and rear surface of the booster impeller 40 is combined indirectly by the vane sides 45, which forms a rotation body in a shape of circular block. The vane tip 43 of vane 42 can shear on the inner circumference of the pressure cylinder 23, and a gaseous floating gap 24 is separated between the front, rear surface of pressure cylinder 23 and the spoke 44, providing an air cushion effect of gaseous buffering. In addition, as the circular area of the spoke 44 is the same as that of pressure cylinder 23, the pressure of air distributed in the floating gaps 24 is uniform. Therefore, the air cushion effect is formed to equalize the pressure on two sides of the booster impeller 40, so that when the booster impeller 40 operates in high speed, the booster impeller 40 will not deviate axially. In principle, the booster impeller 40 is supported by the primary shaft 31 to operate in a fixed direction, and that operational direction is perpendicular to the rotation axis S. The air cushion effect of floating gaps 24 should be able to assist and support the positioning of booster impeller 40. Furthermore, as the input air is uniformly filled in the pressure cylinder 23, and the air is at a same density per unit time, the vibration on the surface of booster impeller 40 can be avoided under the function of air cushion effect. Wherein, the mechanical strengths of the spoke 44, vanes 42 and covering drum 20 are large enough to compete with the working pressure inside the pressure cylinder 23.

Figure 6:
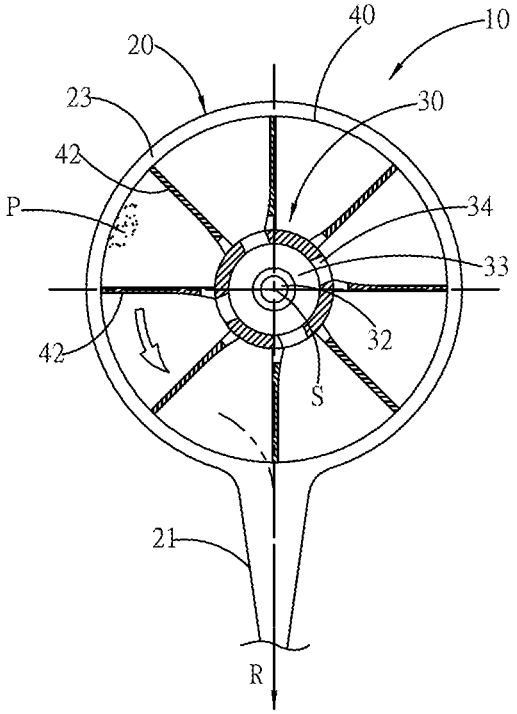
FIG. 6 shows a front view of the pressure-generating unit, according to the present invention.

Referring to FIG. 6, the booster impeller 40 of the pressure-generating unit 10 is disposed in the pressure cylinder 23 of the covering drum 20 to operate, whereas the processed materials are entrained into the pressure cabin 33 from the entrance 32, and then transmitted into the working envelope from the pressure rabbets 34. During the process, the materials are operated by the booster impeller 40 to circulate and swarm at least one round in one time inside the pressure cylinder 23. A location on the outer circumference of the pressure cylinder 23 is connected outward with an exit port 21 which is in contact with ambient atmospheric pressure. Therefore, the high pressure formed in the pressure cylinder 23 will be released from the exit port 21, allowing the substances (processed materials) to be released according to the swarming route R which faces outward.

The longitudinal line of the exit port 21 is superimposed with the rotation axis S, so that entered particulate substances P can be circulated multiple times in the pressure cylinder 23. On the other hand, as the nano-sized products are small in mass, there will not be enough momentum from the multiplication of mass by velocity. Therefore, they will be distributed outward toward the exit port 21 along the swarming route R, wherein the longitudinal line of the exit port 21 is superimposed with the rotation axis S. When one vane 42 reaches the exit port 21, the vane surface is parallel to the longitudinal line of the exit port 21, and the pressing efficiency is lower. Therefore, only part of pressure generated from the operation of the booster impeller 40 is released from the exit port 21, and other part of pressure is circulated in the pressure cylinder 23. In the circulation process, the swarming substances that circulate in the pressure cylinder 23 can be disintegrated repeatedly by the change in squeezing force and fluid pressure inside the pressure cylinder 23.

Furthermore, the formed pressure wave will pull the particulate substances P that are in adjacent to the outer circumference of the pressure cylinder 23 back into the booster impeller 40, and the particulate substances P will be disintegrated again by the momentum from the mechanical percussion onto the vane surface of the vane 42. The entered particulate substances P will be partly circulated inside the pressure cylinder 23, and the particulate substances P in circulation can have a larger probability of being smashed in high pressure. Whereas, as the nano-sized substances are very small in mass, they can be easily driven out of the exit port 21 following the streamlines of airflow on the swarming route R.

Figure 7:
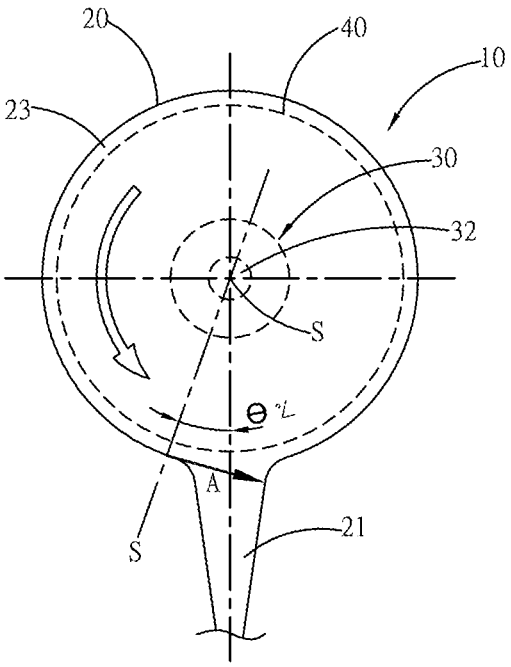
FIG. 7 shows a schematic view of a position of exit port provided by the pressure-generating unit, according to the present invention.

Referring to FIG. 7, the pressure from the rotation of the booster impeller 40 in the covering drum 20 of the pressure-generating unit 10 is released from the exit port 21. As the longitudinal line of the exit port 21 is superimposed with the rotation axis S, the pressure formed will start releasing from an opening on a side of the exit port 21 opposite to the direction of rotation. Whereas, as the vector of momentum A formed in an angle θ is small, part of the processed materials entering into the pressure cylinder 23 will circulate explicitly inside the pressure cylinder 23 to increase the probability of disintegration.

Figure 8:
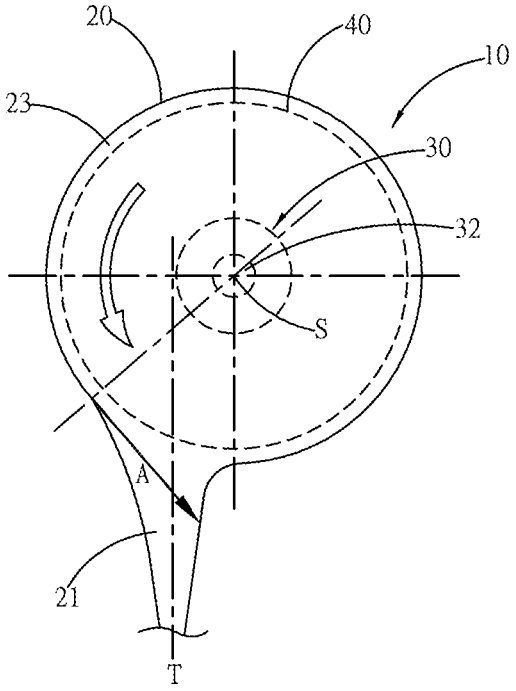
FIG. 8 shows part of FIG. 7.

Referring to FIG. 8, the pressure from the operation of the booster impeller 40 provided by the pressure-generating unit 10 is released from the exit port 21. If the longitudinal line of the exit port 21 is offset from the tangent T at which the rotation axis S operates in parallel, then the width of opening on the exit port 21 facing the direction of rotation will be increased, forming a larger discharge vector of momentum A.

Figure 9:
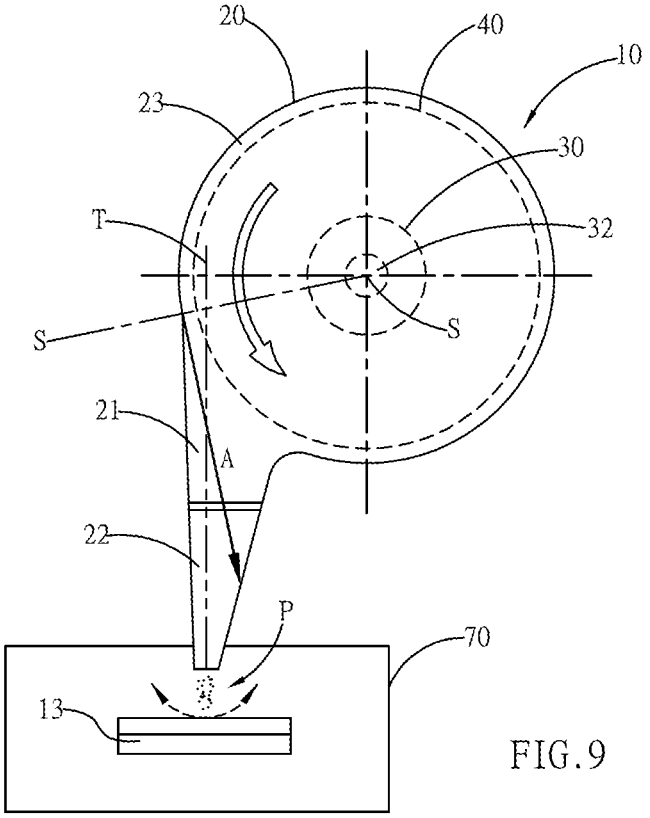
FIG. 9 shows a schematic view of a counter pillow which is disposed in the exit direction of exit port, according to the present invention.

Referring to FIG. 9, if the longitudinal line of the exit port 21 is parallel to the tangent T on the outer circumference of the booster impeller 40, then airflow can be discharged from the opening of the exit port 21, forming the largest discharge vector of momentum A. By this way, the substances that enter into the pressure cylinder 23 will have a lower probability of circulation. Therefore, a counter pillow 13 can be used to provide an equal reaction effect to the high-momentum particulate substances P released from the exit port 21 to achieve the hammering effect, thereby aiding the disintegration operation. Moreover, the hammering space can be enclosed by a separation device 70, so that the disintegrated substances will not drift. The momentum of airflow outputted from the exit port 21 can be further increased by an accelerating tube 22, allowing the passing substances to achieve higher momentum by the multiplication of mass by higher velocity. The momentum will percuss on the surface of the counter pillow 13 in a vertical angle, and the counter pillow 13 will feedback with an equal force to shatter the particulate substances, which even increases the fineness thereof. The abovementioned counter pillow 13 can be implemented on an outlet of any exit port 21.

Figure 10:
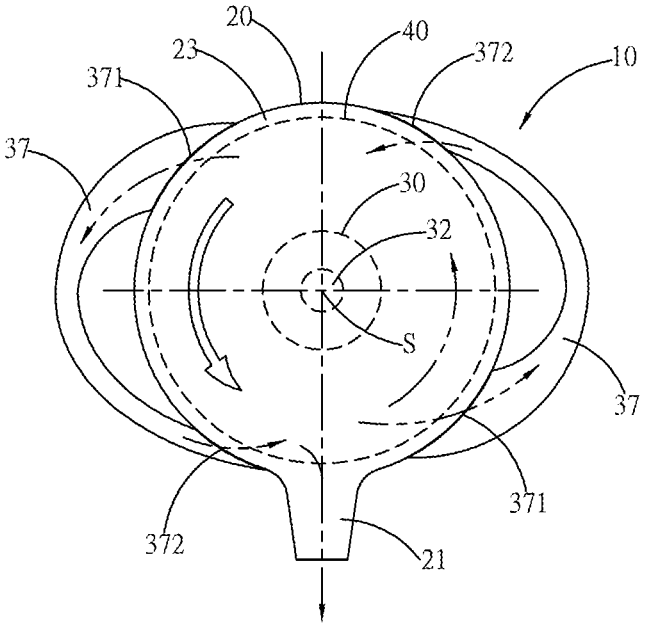
FIG. 10 shows a front view of a covering drum which is connected with a feedback tube, according to the present invention.

Referring to FIG. 10, the longitudinal line of the exit port 21 is superimposed with the rotation axis S. Therefore, the change in pressure difference from the booster impeller 40 is small, but the rotation speed is high. To actually control the entered processed materials, so that they can be circulated multiple times inside the pressure cylinder 23, a location on the circumference of the pressure cylinder 23 is connected and combined with a feedback tube 37. The feedback tube 37 is provided with a follower port 371 and a return port 372, the follower port 371 faces the direction of operation of the booster impeller 40, and the return port 372 follows the direction of operation of the booster impeller 40. The follower port 371 is a larger opening, and the pressure from the booster impeller 40 can enter from the follower port 371 and can be outputted in high speed from the return port 372. By the assistance of the feedback tube 37, in addition to being circulated inside the pressure cylinder 23 of the covering drum 20, the entered materials that circulate in the pressure cylinder 23 can even have a higher probability of being disintegrated by the front-back feeding operation of the feedback tube 37. In addition, there can be two sets of symmetric feedback tubes 37 that are equiangularly joined on the outer circumference of the covering drum 20 to connect with the pressure cylinder 23.

Referring to FIG. 11, the booster impeller 40 provided by the pressure-generating unit 10 is disposed in the covering drum 20, wherein the vanes 42 are combined with the draining shaft 30 by the root portions 41. The vane 42 is a flat plate, as the pressure formed is higher for same power per unit speed of rotation.

Referring to FIG. 12, the booster impeller 40 provided by the pressure-generating unit 10 is positioned in the covering drum 20, wherein the vanes 42 are combined with the draining shaft 30 by the root portions 41. The lateral cross-section of the vane 42 is in a shape of arch, as the surface area of the vane 42 can be increased under the condition that the width of vane surface is constant, which increases the fluid pressure F toward the exit port 21 for a same speed of rotation.

Referring to FIG. 13, the booster impeller 40 is formed by a series of radial and equiangular vanes 42 that are combined in a center of spoke 44. The vanes 42 are combined with the draining shaft 30 at the root portions 41, and two vane sides 45 of each vane 42 are combined respectively with the spoke 44, forming a round block of booster impeller 40. The longitudinal direction of the vane 42, opposite to the direction of operation of the booster impeller 40, is concaved with a collecting trough 46 with length. The collecting trough 46 is gradually formed from the root portions 41 to the outer side, reaching vane tips 43 to form a bus port 47 with a concaved cross section. The airflow formed after the operation of the booster impeller 40 will reach the highest gas density from the bus port 47, forming relatively the highest pressure and a pressure bus line L which is distributed annularly. By the bus port 47, the pressure will be distributed linearly on the pressure bus line L, which can concentrate the entered working particulates and can also focus the pressure, so that the particulates can be collided with one another and be crushed by pressure, thereby increasing the disintegration efficiency.

Referring to FIG. 14, the vanes 42 provided by the booster impeller 40 are provided with an arch-shaped radial cross section. On the surface of vane 42, the collecting trough 46 is longitudinally disposed opposite to the direction of operation. The collecting trough 46 is extended from the root portions 41 to the vane tips 43, preserving a concaved bus port 47 to form a pressure bus line L in the same working method as that in FIG. 13.

Figure 15:
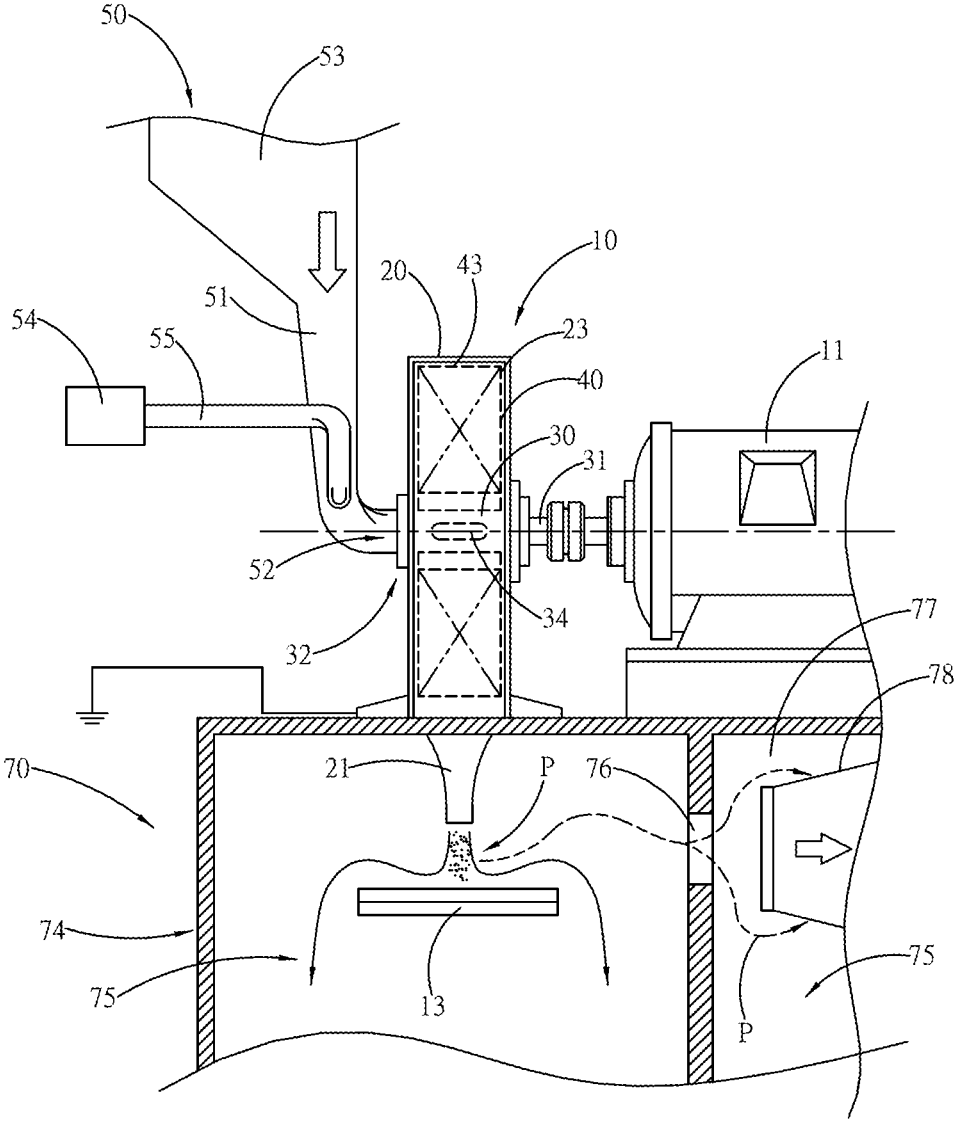
FIG. 15 shows an assembly view of a separation device relative to the pressure-generating unit, according to the present invention.

Referring to FIG. 15, for the pressure-generating unit 10 provided by the present invention, the power unit 11 drives the draining shaft 30 to operate the booster impeller 40, allowing the pressure cylinder 23 in the covering drum 20 to generate the pressure. The viewable particulates of the processed materials (not shown on the drawing) enter into a stock unit 53 from the feeding unit 50. The particulates are delivered by the stock unit 50 through the piping 51, and are finally fed into the entrance 32 of the draining shaft 30 from the feeding port 52, followed by being transmitted to the space of pressure cylinder 23 from the pressure rabbets 34 of the draining shaft 30. The materials after disintegration by the operation of pressure-generating unit 10 are first enclosed by a covering box 74 of the separation device 70, and then are transmitted by the pressure from a notch 76. After being buffered by a buffering space 77, the processed particulate substances P that have entered can be filtered uniformly from a surface of filtering element 78 into the requested nano-sized substances. The larger substances from filtering will then be accumulated as a stockpile in a hoarding space 75 by gravity or external force such as gas ballast power.

After being outputted from the exit port 21 by the pressure-generating unit 10, the particulate substances P can work on a counter pillow 13, causing the percussion effect from the surface of counter pillow 13 to aid the subsequent disintegration. The nano-sized substances that are disintegrated are transmitted by pressure to the buffering space 77 from the notch 76, and then are disintegrated again through the counter pillow 13; whereas, larger grains will be also left in the hoarding space 75.

By the separation operation of the separation device 70, the filtering element 78 can select the requested nano-sized particulates effectively.

For the operation of the booster impeller 40 in the pressure-generating unit 10, if the rotation speed of a drive shaft of the power unit 11 reaches 15,000 rpm and the overall diameter of the booster impeller 40 is 45 cm, then a very large pressure difference can be formed between the entrance 32 and the outer periphery of the pressure cylinder 23. Besides, even a circular speed at the vane tip 43 can achieve the magnitude of critical sonic velocity. When the circular speed exceeds the magnitude of sonic velocity, ablation can be formed to air between the inner circumference of the pressure cylinder 23 and the vane tip 43, and the ablation can result in sonic boom. In addition, the temperature in the pressure-generating unit 10 from high-speed operation can be extremely high. To maintain safety in the pressure-generating unit 10, inert gas such as nitrogen can be guided in from the entrance 32 through a feed-in pipe 55, or low-temperature air can be guided in from an auxiliary device 54 to prevent from causing high temperature in the pressure-generating unit 10, thereby maintaining the safety of equipment.

Figure 16:
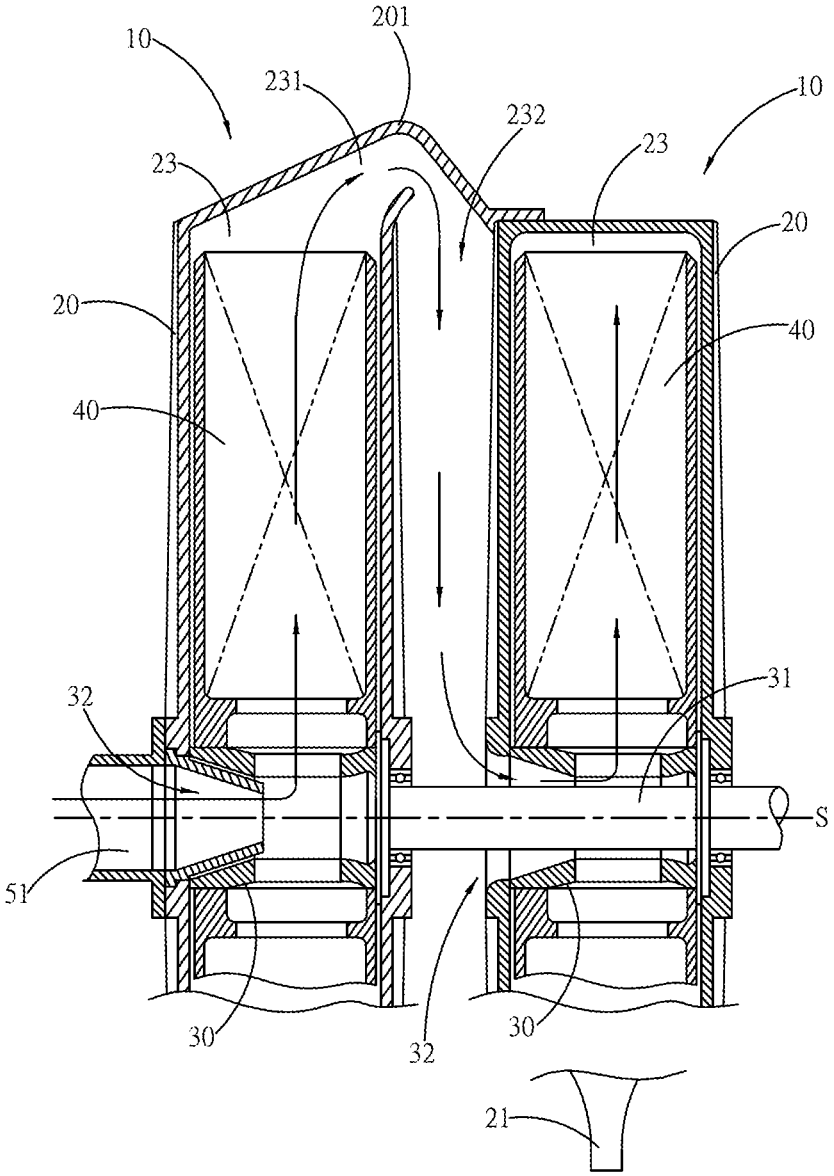
FIG. 16 shows a schematic view of the pressure-generating unit which is combined front and back, according to the present invention.

Referring to FIG. 16, the pressure-generating unit 10 can be configured as a front set and a rear set, operating simultaneously and coaxially against the rotation axis S. The difference is that the outer circumference of the covering drum 20 provided by the prepositional pressure-generating unit 10 escapes from the enclosure of the pressure cylinder 23 and is expanded with an annular rim 201 which is joined front and back. The annular rim 201 is in a shape of bulged belly, so as to yield a back delivery port 231 on the periphery of the pressure cylinder 23. In addition, a swarming route 232 is formed between the covering drums 20 of the front set and the rear set of the pressure-generating unit 10. In operation, the processed materials enter a working space of the draining shaft 30 and the booster impeller 40 from the entrance 32 of the prepositional pressure-generating unit 10. Whereas, the pressure generated from the booster impeller 40 is transmitted from the back delivery port 231 and the swarming route 232, and enters backward into the entrance 32 of the postpositional pressure-generating unit 10 to boost the postpositional pressure-generating unit 10. Therefore, a disintegration operation in higher pressure can be performed in the space of pressure cylinder 23 of the postpositional pressure-generating unit 10, and finally the processed materials are discharged out of the exit port 21 provided by the postpositional pressure-generating unit 10. By superimposing the prepositional pressure-generating unit 10 with the postpositional pressure-generating unit 10 in front and back, along with being driven by the same primary shaft 31, an explicit boosting disintegration capability can be achieved.

Figure 17:
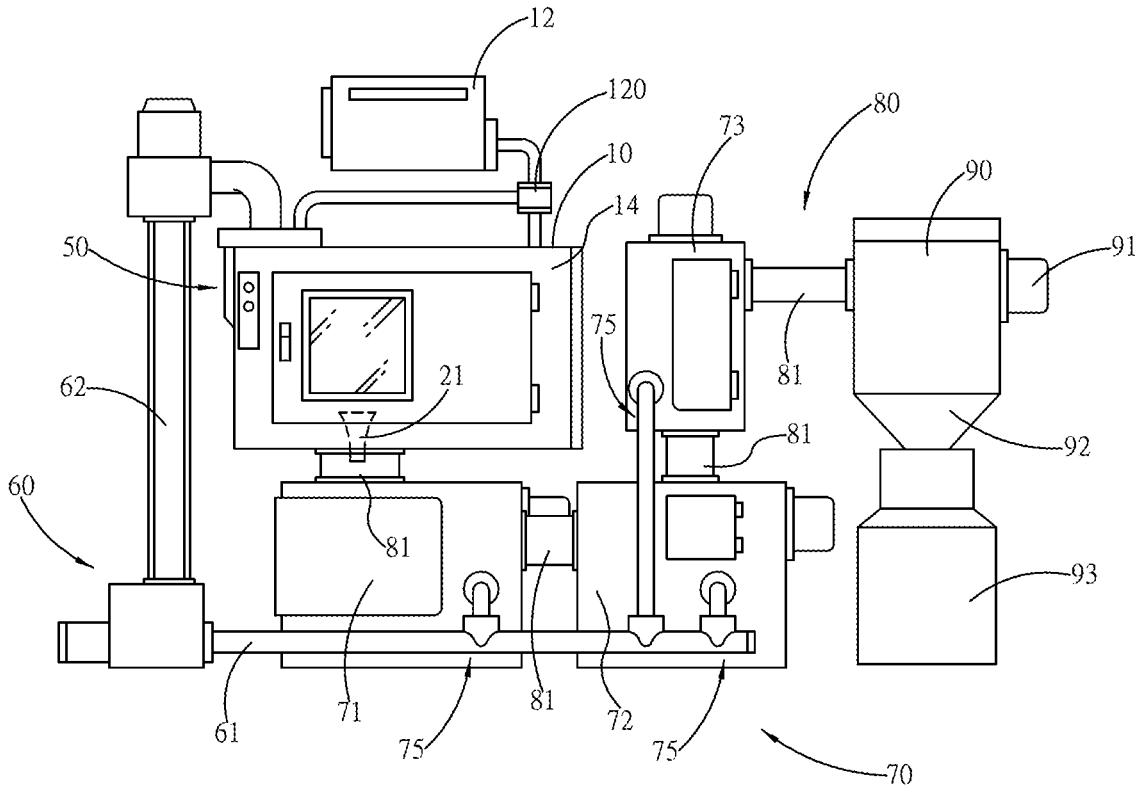
FIG. 17 shows a schematic of an entire system of auxiliary equipment, according to the present invention.

Referring to FIG. 17, the pressure-generating unit 10 of the present invention is applied to a precision operating system, wherein the pressure-generating unit 10 is enclosed by a box unit 14, and a rear end of the exit port 21 is followed by the separation device 70. A tail end of the separation device 70 is combined with a collecting device 90, wherein the separation device 70 can be connected serially in multiple sets, including a first separation device 71, an intermediate separation device 72 and a rear separation device 73 which are connected serially by a cascade passage 81. The first separation device 71, the intermediate separation device 72 and the rear separation device 73 are connected parallel with the internal hoarding space 75 by a retrieving path 61 respectively. A retrieving device 60 generates a mechanical pushing operation to implement the retrieving path 61 to result in a repulsion action such as pushing in a spiral route, retrieving the working substances kept in the hoarding space 75 for reprocessing. Finally, the processed materials are returned reversely into the feeding unit 50 of the pressure-generating unit 10 from a return path 62 which is connected to the feeding unit 50. The equipment enables the unprocessed materials (not shown in the drawing) to be retrieved from the retrieving device 60, and then to be delivered reversely to the feeding unit 50, thereby forming a cyclic processing operation.

The collecting device 90 collects the finished materials from a transfer unit 93 via an outlet 92. The collecting device 90 can aid the generation of the gaseous pressure difference by a negative-pressure draining unit 91, wherein the negative pressure resulted from the negative-pressure draining unit 91 operates on the separation device 70, and the positive pressure operates on the outlet 92.

In the space of pressure-generating unit 10, a refrigerating function can be formed by a refrigerating device 12. The low-temperature energy resulted from the refrigerating device 12 is transmitted to the pressure-generating unit 10 to cool down the internal systems of the pressure-generating unit 10. A delivery unit 120 can be used to transmit the low temperature into the pressure-generating unit 10, or the low temperature can be transmitted to the feeding unit 50 via another path, and then the feeding unit 50 transmits the low-temperature energy from the refrigerating device 12 to the pressure-generating unit 10.

A streaming route 80 is formed between the pressure-generating unit 10 and the collecting device 90 by serial connection, wherein the separation device 70 is divided into multiple sections to acquire the nano-sized materials in a uniform scale at the terminal point more efficiently. The materials processed by the pressure-generating unit 10 are dry substances, including organic materials, inorganic materials or chemical compounds.

The collecting device 90 performs the collecting operation, with the working pressure equal to or smaller than the positive pressure at the outlet of the exit port 21. When the pressure outputted from the pressure-generating unit 10 passes through the first separation device 71, the intermediate separation device 72 and the rear separation device 73, undergoes a filtering in resistance consumption and finally reaches the collecting device 90, the flow speed on the streaming route 80 will reduce to a moderate state. Therefore, the negative-pressure draining unit 91 is used to aid the draining power of the streaming route 80.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A dry nano-sizing equipment with fluid mobility effect, comprising:

a power unit; and a pressure-generating unit comprising a rigid covering drum, a draining shaft and a booster impeller, wherein an interior of the rigid covering drum is formed with a round-cabin-shaped pressure cylinder which rotates in conjugation with and surrounds a rotation axis, and an outer circumference of the pressure cylinder is connected outward with an exit port; a center line of the draining shaft is superimposed with the rotation axis, an end of the draining shaft is provided with a primary shaft, the primary shaft is driven by the power unit, an other end of the draining shaft is provided with an entrance, the entrance is connected inward along the rotation axis with a round-cabin-shaped pressure cabin which is disposed coaxially, the pressure cabin is disposed on an end of the primary shaft and is sealed with a radial plate, and two pressure rabbets are distributed equiangularly and symmetrically on an outer circumference of the draining shaft to connect with the pressure cabin; a round-plate-shaped booster impeller is composed of plural vanes which are distributed equiangularly and radially, a root portion of each vane of the plural vanes is combined on the outer circumference of the draining shaft, and a bus rabbet is disposed between the plural vanes and the outer circumference of the draining shaft.

2. The dry nano-sizing equipment with fluid mobility effect, according to claim 1, wherein two end surfaces of the round-plate-shaped booster impeller are combined respectively with a spoke.

3. The dry nano-sizing equipment with fluid mobility effect, according to claim 1, wherein a longitudinal surface of the each vane of the plural vanes of the booster impeller is concaved with a longitudinal collecting trough which is opposite to a direction of operation, and a bus port is formed at a location where a collecting trough is interconnected with a vane tip, according to a shape of the collecting trough.

4. The dry nano-sizing equipment with fluid mobility effect, according to claim 1, wherein a circumferential surface of the pressure cylinder of the covering drum is divergently provided with two arch-shaped feedback tubes at symmetric angles according to a direction of rotation, and a feedback tube is provided with a follower port in a large aperture and a release port in a small aperture, with the follower port facing the direction of operation of the booster impeller, and the release port following the direction of operation of the booster impeller, based upon a curve of a body of the feedback tube.

5. The dry nano-sizing equipment with fluid mobility effect, according to claim 1, wherein the pressure-generating unit is divided coaxially into a front set and a rear set, with a swarming route being separated therebetween, the outer circumference of the pressure cylinder of the pressure-generating unit, which is prepositional, extends backward through an annular rim to enclose and open a back delivery port to connect with the swarming route, and a center in the swarming route is connected annularly with the entrance of the postpositional pressure-generating unit which is provided with an exit port.

6. The dry nano-sizing equipment with fluid mobility effect, according to claim 1, further comprising:

a box unit to enclose an outer space of the pressure-generating unit;

a separation device connected with the exit port of the pressure-generating unit;

a feeding unit provided with a piping, with a feeding port provided by the piping being connected with an entrance of the pressure-generating unit;

a retrieving device, provided with a retrieving path and a return path to perform a pushing action, with the return path being connected with the feeding unit to form a transportation route to send back processed materials; and a collecting device following the separation device.

7. The dry nano-sizing equipment with fluid mobility effect, according to claim 6, wherein the separation device is serially connected in two sets, with a first separation device being connected with the exit port of the pressure-generating unit via a cascade passage, followed by connecting serially to a rear separation device which is connected with the collecting device.

8. The dry nano-sizing equipment with fluid mobility effect, according to claim 6, wherein a working pressure of the collecting device is smaller than an exit pressure of the exit port.

9. The dry nano-sizing equipment with fluid mobility effect, according to claim 6, wherein the collecting device is provided with a negative-pressure draining unit, which generates a negative pressure to operate on the separation device, and a positive pressure to operate on an outlet.

10. The dry nano-sizing equipment with fluid mobility effect, according to claim 6, wherein the pressure-generating unit is connected to a refrigerating device which generates energy to operate on the pressure-generating unit.

* * * * *